US011122944B2

(12) United States Patent
Massaro

(10) Patent No.: US 11,122,944 B2
(45) Date of Patent: Sep. 21, 2021

(54) SWEEPING MACHINE FOR FLOORS AND CARPETS

(71) Applicant: LINDHAUS S.R.L., Padua (IT)

(72) Inventor: Michele Massaro, Noventa Padovana (IT)

(73) Assignee: LINDHAUS S.R.L., Padua (IT)

( * ) Notice: Subject to any disclaimer, the term of this patent is extended or adjusted under 35 U.S.C. 154(b) by 414 days.

(21) Appl. No.: 16/096,359

(22) PCT Filed: Apr. 26, 2017

(86) PCT No.: PCT/IB2017/052409

§ 371 (c)(1),
(2) Date: Oct. 25, 2018

(87) PCT Pub. No.: WO2017/187361

PCT Pub. Date: Nov. 2, 2017

(65) Prior Publication Data

US 2021/0093133 A1 Apr. 1, 2021

(30) Foreign Application Priority Data

Apr. 27, 2016 (IT) ..... 102016000042637

(51) Int. Cl.
*A47L 5/30* (2006.01)
*A47L 9/04* (2006.01)
(Continued)

(52) U.S. Cl.
CPC ..... *A47L 5/30* (2013.01); *A47L 9/0411* (2013.01); *A47L 9/0444* (2013.01);
(Continued)

(58) Field of Classification Search
CPC ..... A47L 5/30; A47L 9/0411; A47L 9/0444; A47L 9/0477; A47L 11/24; A47L 11/33;
(Continued)

(56) References Cited

U.S. PATENT DOCUMENTS 6,099,661 A * 8/2000 Conrad ..... A47L 5/30 134/21
2003/0196294 A1 10/2003 Conrad
(Continued)

FOREIGN PATENT DOCUMENTS

CN 102677614 A 9/2012
EP 0346796 A2 12/1989
(Continued)

OTHER PUBLICATIONS

International Search Report and Written Opinion dated Oct. 13, 2017 issued in PCT/IB2017/052409.
Italian Search Report dated Mar. 16, 2017 issued in IT UA20162914, with partial translation.

*Primary Examiner* — David Redding
(74) *Attorney, Agent, or Firm* — Scully, Scott, Murphy & Presser, P.C.

(57) ABSTRACT

A sweeping machine for floors and carpets, comprising a body with wheels for gliding and a maneuvering handle, the body supporting at least one cleaning roller that has a horizontal axis and is actuated by an electric motor by virtue of torque transmission elements; there are elements for the suction of air from a region proximate to the at least one cleaning roller, the suction elements being actuated by the same electric motor for driving the at least one cleaning roller.

8 Claims, 3 Drawing Sheets

(51) Int. Cl.
*A47L 11/33* (2006.01)
*A47L 11/40* (2006.01)
*A47L 11/24* (2006.01)

(52) U.S. Cl.
CPC ..... *A47L 9/0477* (2013.01); *A47L 11/24* (2013.01); *A47L 11/33* (2013.01); *A47L 11/4069* (2013.01)

(58) Field of Classification Search
CPC ..... A47L 11/4069; A47L 5/28; A47L 7/02; A47L 9/04; A47L 11/32
See application file for complete search history.

(56) References Cited

U.S. PATENT DOCUMENTS

| | | | | |
|---|---|---|---|---|
| 2004/0168281 | A1 | 9/2004 | Sako et al. | |
| 2016/0198918 | A1* | 7/2016 | Sun | A47L 5/30 15/347 |

FOREIGN PATENT DOCUMENTS

| | | | |
|---|---|---|---|
| GB | 2396801 | A | 7/2004 |
| GB | 2419275 | A | 4/2006 |
| WO | WO 2015/183778 | A1 | 12/2015 |

* cited by examiner

SWEEPING MACHINE FOR FLOORS AND CARPETS

The present invention relates to a sweeping machine for floors and carpets.

Sweeping machines for predominantly domestic use or in any case dedicated to limited surfaces, known in the jargon as "mini-sweepers", are currently increasingly widespread.

These commercially available mini-sweepers are structured to perform a mechanical collection of dust and debris, which are removed from the floor or carpet and partially deposited in a removable rigid container.

This purely mechanical collection causes the lifting of dust and debris which, if they are not propelled mechanically into the collection container, risk remaining suspended in the air; this drawback prevents the use of these known mini-sweepers in indoor environments, home environments, sanitary environments and in the presence of allergic subjects, since in these situations the lifting of the dust might cause several problems.

These known mini-sweepers generally have, in order to perform mechanical collection, a roller provided with bristles which rotates either in the direction of travel (direct load) or in the opposite direction with respect to the direction of travel (reverse load).

This type of mini-sweeper is generally powered by a battery and is almost exclusively suitable for hard floors.

The motor used in these known mini-sweepers is of the direct current type with permanent magnets, has a very low power (20-50 W), and is connected to the roller with bristles by means of a flat belt which also acts as a clutch in case of roller jamming.

More professional mini-sweepers are provided with a toothed belt for connection between the motor and the roller with bristles and with an electronic board for controlling the overload, and therefore have a greater technical complexity and therefore a higher cost.

However, the cleaning efficiency of these mini-sweepers on bare floors and floors with gaps is minimal, and it is the same on carpets.

The aim of the present invention is to provide a sweeping machine that is capable of obviating the cited limitations and drawbacks of mini-sweepers of the known type.

Within this aim, an object of the invention is to provide a sweeping machine that can be used in indoor environments, domestic environments, sanitary environments and in the presence of allergic subjects.

Another object of the invention is to provide a sweeping machine that is capable of providing a more effective action of removal and retention of dust and debris.

A further object of the invention is to provide a sweeping machine that has a performance that can be compared with that of professional carpet cleaning machines but is cheaper and has a lower energy consumption.

Another object of the invention is to provide a sweeping machine that is versatile and can be set up easily for other uses.

This aim, as well as these and other objects which will become better apparent hereinafter, are achieved by a sweeping machine for floors and carpets according to claim 1.

Further characteristics and advantages of the invention will become better apparent from the description of a preferred but not exclusive embodiment of the sweeping machine according to the invention, illustrated by way of nonlimiting example in the accompanying drawings, wherein.

Figure 1:
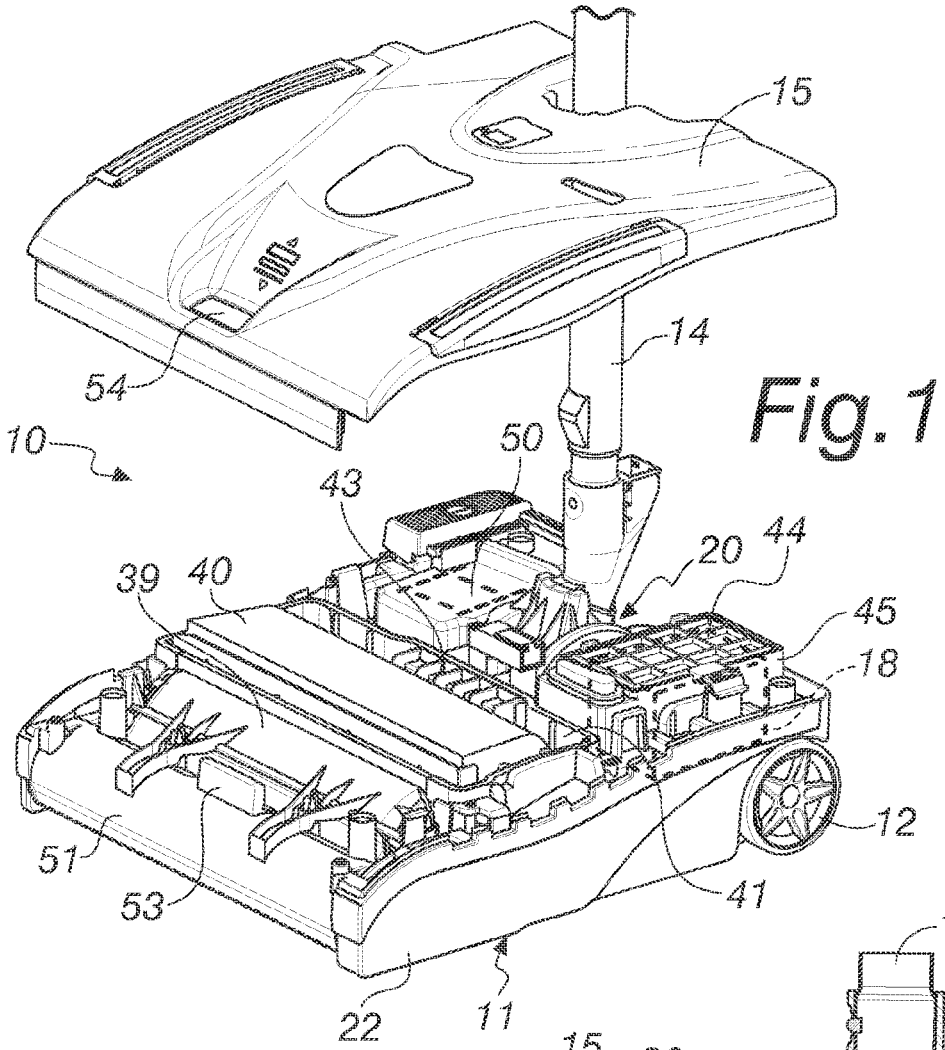
FIG. 1 is a partially exploded perspective view of a sweeping machine according to the invention.
Figure 2:
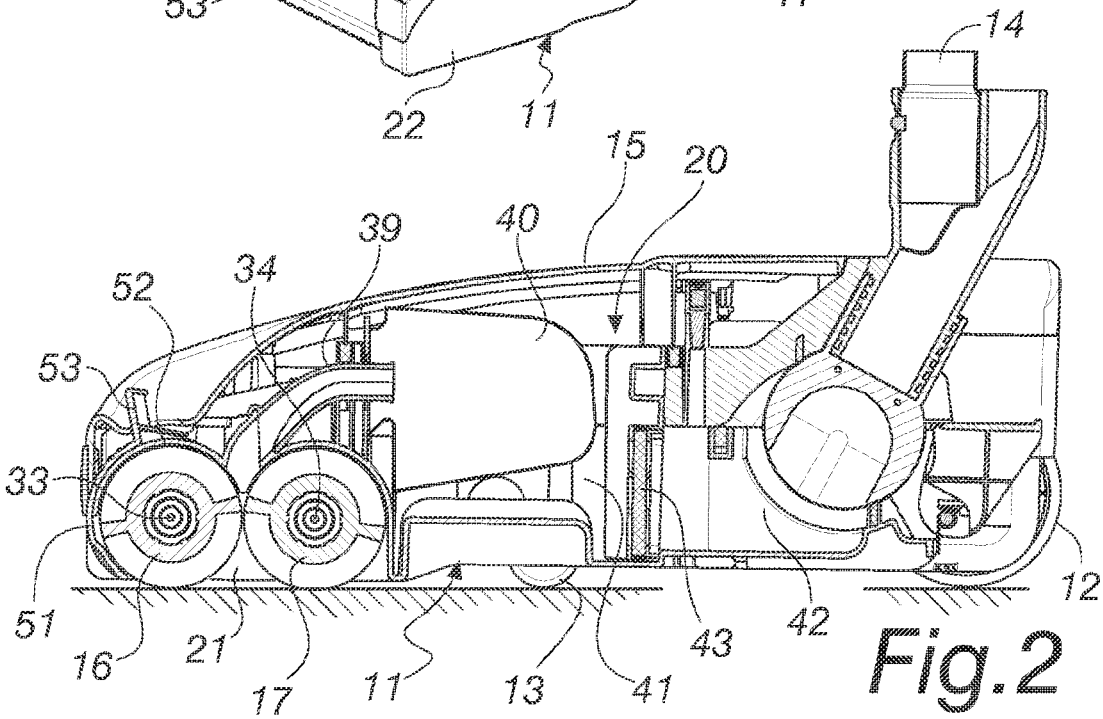
FIG. 2 is an overall sectional side view of the sweeping machine of FIG. 1.

With reference to the figures, a sweeping machine for floors and carpets according to the invention is designated generally by the reference numeral 10.

The sweeping machine 10 comprises a body 11 with wheels for gliding 12 and 13 and a maneuvering handle 14; the body 11 is closed in an upper region by a cover 15 and supports at least one cleaning roller, for example two cleaning rollers 16 and 17.

The two cleaning rollers 16 and 17 have a horizontal axis and are driven by an electric motor 18 by virtue of torque transmission means 19.

The sweeping machine 10 according to the invention comprises means 20 for the suction of air from a region 21 proximate to the cleaning rollers 16 and 17.

The suction means 20 are driven by the same electric motor 18 that drives the cleaning rollers 16 and 17.

In particular, hereinafter the two cleaning rollers with parallel axes 16 and 17 are designated as a first cleaning roller 16 and a second cleaning roller 17, the second roller 17 being driven by the same electric motor 18 that drives the first cleaning roller 16.

The first and second cleaning rollers 16 and 17 are arranged so as to operate side by side at a front part of the body 11.

The rotation axis X1 of the electric motor 18 is parallel to the rotation axis X2 and X3 of the cleaning rollers 16 and 17.

The torque transmission means 19 comprise a first belt 25 of a first belt transmission element 26 between the shaft 27 of the electric motor 18 and a reduction pulley 28, and a second belt 29 of a second belt transmission element 30 between the reduction pulley 28 and two final pulleys 31 and 32, each of which is fixed to the rotation shaft 33 and 34 of a corresponding first cleaning roller 16 and second cleaning roller 17.

The cleaning rollers 16 and 17 are pivoted to two opposite shoulders 35 which are comprised within the body 11.

Figure 3:
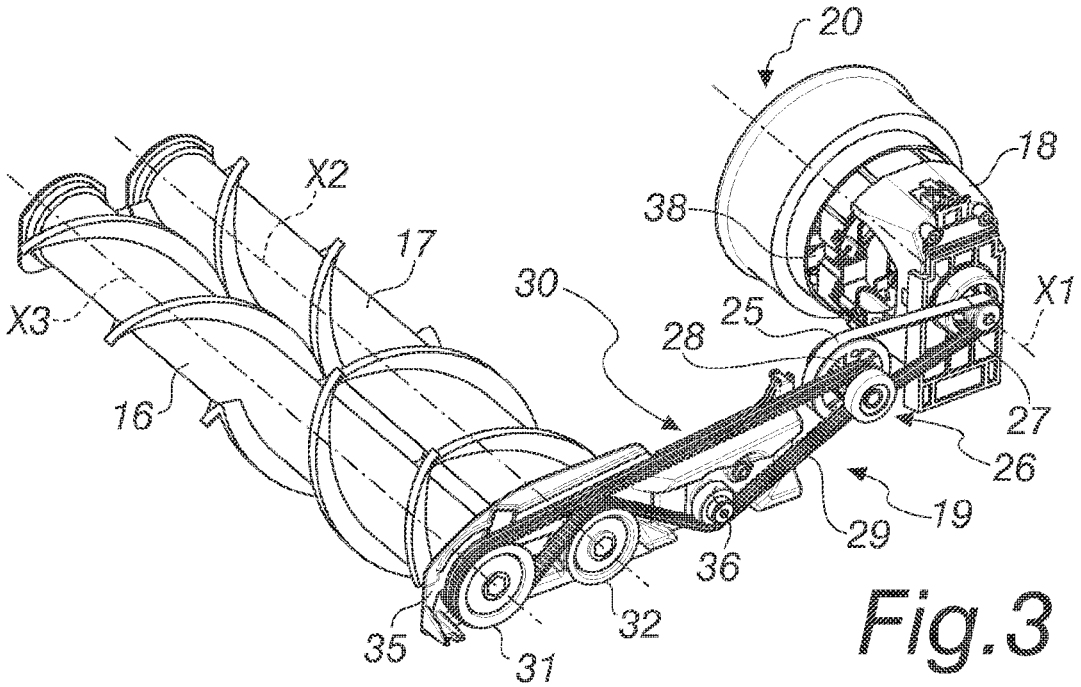
FIG. 3 is a perspective view of a set of components of the sweeping machine according to the invention.

The second belt 29 passes above a first pulley 31 of a first cleaning roller 16 and below the second pulley 32 of the second laterally adjacent cleaning roller 17, as clearly visible in FIG. 3.

This arrangement causes the rotation of the two cleaning rollers 16 and 17 in opposite directions.

There is also a belt tensioning pulley 36 which is interposed between the reduction pulley 28 and the second pulley 32.

The belt tensioning pulley 36 and the reduction pulley 28 are supported by corresponding brackets in a manner which is to be understood as known.

For example, the first belt 25 is of the Poly-V type, but as an alternative it can be constituted by a flat or toothed belt.

For example, the second belt 29 is of the type with teeth on one side and of the Poly-V type on the other, so as to work both on its inner side and on its outer side in order to obtain the contrarotation of the rollers 16 and 17; said second belt is to be understood as being obviously replaceable with a belt that is flat on both sides or with a belt that is toothed on both sides.

The suction means 20 comprise a suction fan 38 which is arranged coaxially to the shaft 27 of the electric motor 18 and is turned directly by the shaft 27 of the electric motor 18.

The suction means 20 also comprise an air conveyor 39 that is contoured to aspirate from the region 21 between the two cleaning rollers 16 and 17 and then introduce in a filtering collection container 40, which is removable and is arranged in a compartment 41 of the body 11 between the suction fan 38 and the cleaning rollers 16 and 17.

The filtering container 40 is constituted for example by a filter bag, for example made of three-ply non-woven fabric; as an alternative, it is possible to use a rigid container provided with a filter.

A suction channel 42 is formed between the compartment 41 for the filtering collection container 40 and the suction fan 38 and a motor protection filter 43 is arranged inside it.

Figure 6:
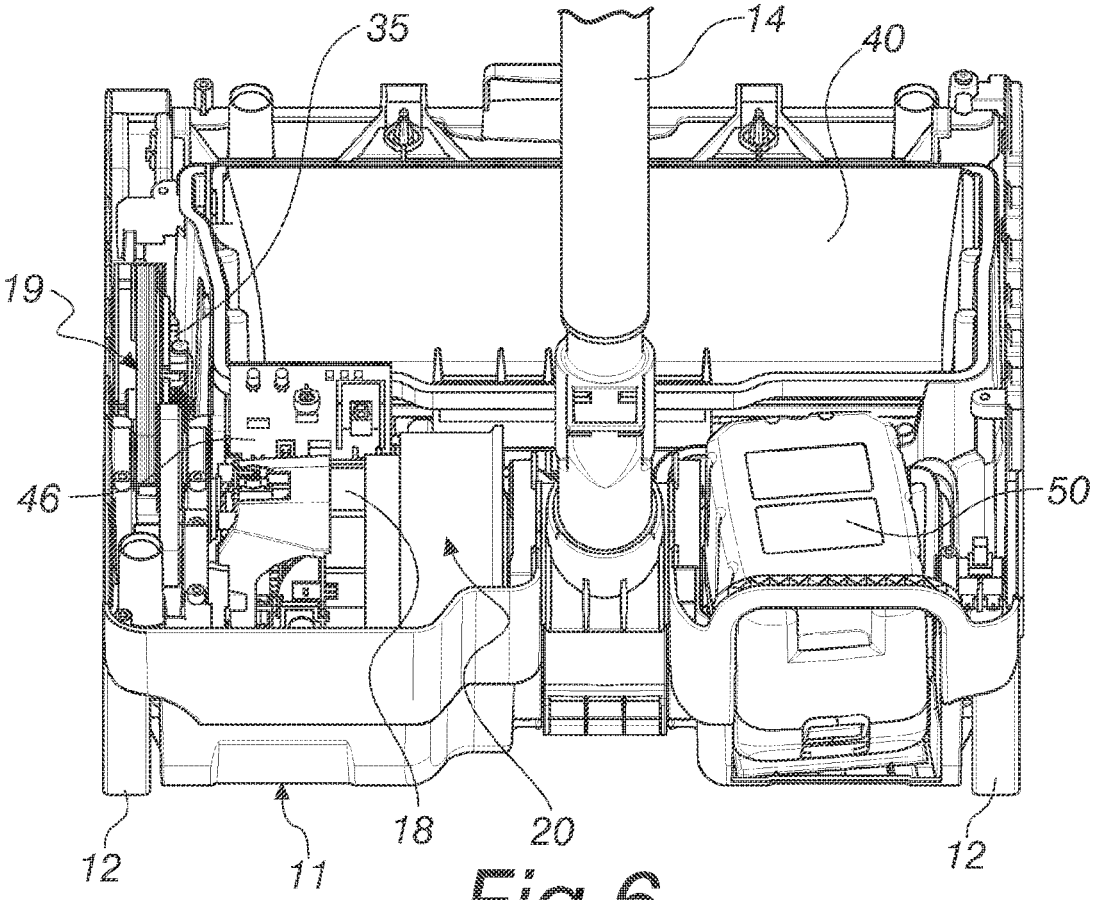
FIG. 6 is a top perspective view of the inside of the sweeping machine according to the invention.

The filtering system of the sweeping machine 10 also comprises a sound-absorbing filter wrapped around the motor 18, not shown for the sake of simplicity in the figures, and a microfiltering partition 44, which closes in an upper region a protective housing 45 for the motor 18 and for a nearby electronic board 46 for the control and management of the sweeping machine 10, the latter being clearly visible in FIG. 6.

By virtue of this filtration system, the net filtering efficiency can reach values of approximately 99% for particles up to 0.3 microns.

The sweeping machine 10 can also comprise a rechargeable battery pack 50, or can operate by means of a wired connection to an electric mains.

The electronic unit 46 operates so that the sweeping machine 10 can have the following functions:

- so-called soft start, i.e., with a rotation rate of the cleaning rollers that is lower than the steady-state rotation rate,
- control of the overload, i.e., of any slowing of a cleaning roller or of both rollers, with indication of any anomalies by means of a green and red LED,
- motor blocking in case of jamming of one or both cleaning rollers,
- indication of the battery charging level by means of LEDs,
- automatic power-off of the sweeping machine in case of low battery voltage with flashing LED indication.

If it is necessary to provide low-cost versions, it is possible to install a much simpler and cheaper electronic control only to control the overload or, as an alternative, two mechanical clutches mounted inside the two cleaning rollers.

The sweeping machine 10 also comprises, at the cleaning rollers 16 and 17 and at the suction region 21, a baffle 51 for the adjustment of the suction opening.

The baffle 51 is constituted by a rotatable shutter, which can rotate about a complementarily shaped front portion 52 of the air conveyor 39, with an axis that is parallel to the axis X3 of the first cleaning roller 16, and is extended so as to surround part of the first cleaning roller 16.

The position of the baffle 51 is adjustable manually by means of a grip tab 53 that protrudes upward from an opening 54 on the body 11.

By rotating the baffle Slit is possible to achieve the maximum yield depending on the type of dust or debris to be aspirated.

Figure 4:
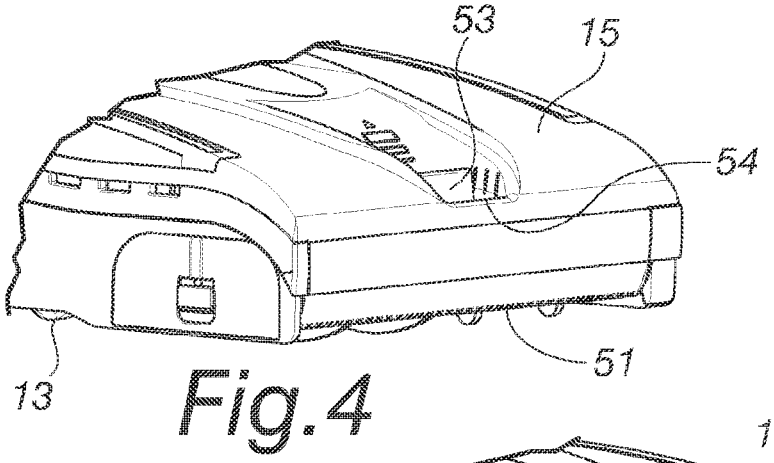
FIG. 4 is a front perspective view of a portion of a sweeping machine according to the invention in a first configuration for use.
Figure 5:
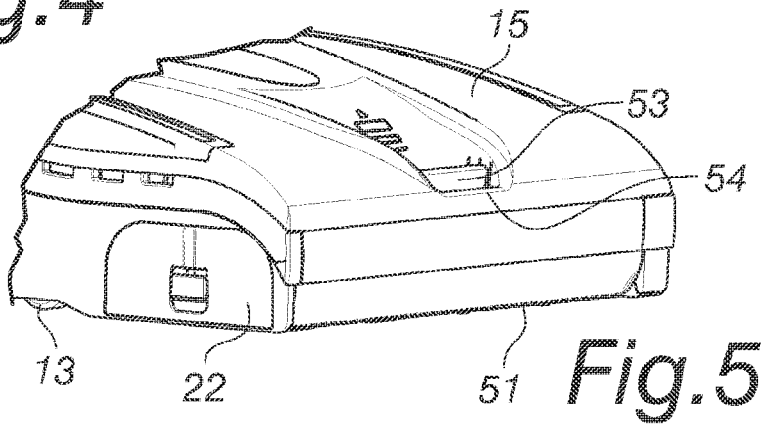
FIG. 5 is a front perspective view of a portion of a sweeping machine according to the invention in a second configuration for use.

For example, three positions are possible for the baffle 51:

- "fully open" position, as shown in FIG. 4, which is adapted to achieve the suction of debris up to 9 mm in thickness; in this case the suction on the ground is almost nil, while control of the aspirated dust is optimum;
- "fully closed" position, as shown in FIG. 5, in order to achieve maximum suction of dust and debris of small size from floors and carpets;
- intermediate position, in order to achieve adequate suction and passage for debris with a maximum thickness of 4 mm.

In practice it has been found that the invention achieves the intended aim and objects.

In particular, the invention provides a sweeping machine whose ability to remove dust from floors is better than all competing mini-sweepers, by virtue of the adoption of the two contrarotating cleaning rollers and of the suction means which prevent the lifted dust and debris from remaining in the environment, aspirating them and retaining them in the filtering container.

Moreover, the invention provides a sweeping machine whose capability for removing dust from carpets is better than that of any commercially available mini-sweeper and is comparable to that which is obtained by using professional carpet cleaning machines with a minimum power of 900 W.

Furthermore, the invention provides a mini-sweeper that can operate both on a battery, with a power of 270 W, and with a wired power supply, with a power of 400 W, which is in any case less than half with respect to any professional commercially available carpet cleaning machine.

Moreover, the invention provides a sweeping machine that can be configured easily for other functions different from the removal and suction of dust and debris; for example, it can be set up for dry cleaning of carpets, by removing the filtering container and applying a conveyor to close the suction inlet; in this manner, the machine utilizes only the mechanical action of the two contrarotating cleaning rollers to massage and send to the bottom of the fibers of the carpet the moist sanitizing microsponges of the adapted cleaning rollers that are used.

In a further example of different configuration for the sweeping machine according to the invention, it can be set up with abrasive cleaning rollers and used to polish floors.

The invention thus conceived is susceptible of numerous modifications and variations, all of which are within the scope of the appended claims; all the details may further be replaced with other technically equivalent elements.

In practice, the components and the materials used, so long as they are compatible with the specific use, as well as the contingent shapes and dimensions, may be any according to the requirements and the state of the art.

The disclosures in Italian Patent Application no. 102016000042637 (UA2016A002914), from which this application claims priority, are incorporated herein by reference.

The invention claimed is:

1. A sweeping machine for floors and carpets, comprising:

a body with wheels for gliding;

a maneuvering handle, said body supporting at least one cleaning roller that has a horizontal axis and is actuated by an electric motor by virtue of torque transmission means and further comprising means for the suction of air from a suction region proximate to said at least one cleaning roller, said suction means being actuated by said same electric motor for driving said at least one cleaning roller; and two cleaning rollers with parallel axes, a first cleaning roller and a second cleaning roller, said second cleaning roller being actuated by said same electric motor for driving said first cleaning roller, wherein said torque transmission means comprise a first belt of a first belt transmission element between a shaft of said electric motor and a reduction pulley, and a second belt of a second belt transmission element between said reduction pulley and two final pulleys, each of which is fixed to a rotation shaft of a corresponding first and second cleaning roller.

2. The sweeping machine according to claim 1, wherein said first and second cleaning rollers are arranged so as to work side by side at a front part of said body, a rotation axis of said electric motor being parallel to rotation axes of said cleaning rollers.

3. The sweeping machine according to claim 1, wherein said second belt passes above one of said final pulleys of a cleaning roller and below another one of said final pulleys of the other laterally adjacent cleaning roller, determining a rotation in opposite directions of the two cleaning rollers.

4. The sweeping machine according to claim 1, wherein said suction means comprise a suction fan that is arranged so as to be coaxial to the shaft of said electric motor and is turned directly by said shaft.

5. The sweeping machine according to claim 4, wherein said suction means comprise an air conveyor that is contoured so as to aspirate from said suction region between the two cleaning rollers and introduce it into a filtering collection container, which is removable and is located in a compartment of the body between the suction fan and the cleaning rollers.

6. The sweeping machine according to claim 5, wherein between said compartment for the collection container and said suction fan there is a suction channel inside which there is a motor protection filter.

7. The sweeping machine according to claim 1, further comprising, at the cleaning rollers and at the suction region, a baffle for adjusting a suction opening.

8. The sweeping machine according to claim 1, further comprising a rechargeable battery pack.

* * * * *